US006095628A

United States Patent [19]

Rhome

[11] Patent Number: 6,095,628

[45] **Date of Patent: *Aug. 1, 2000**

[54] APPARATUS FOR INK JET PRINTING

[76] Inventor: Matthew Rhome, 4501 Manatee Ave. West, #315, Bradenton, Fla. 34209

[ * ] Notice: This patent issued on a continued prosecution application filed under 37 CFR 1.53(d), and is subject to the twenty year patent term provisions of 35 U.S.C. 154(a)(2).

[21] Appl. No.: 08/683,845

[22] Filed: Jul. 19, 1996

[51] Int. Cl.[7] ..... B41J 3/00; B41J 2/01

[52] U.S. Cl. ..... 347/4; 347/105

[58] Field of Search ..... 347/4, 104, 105, 347/108, 16

[56] References Cited

U.S. PATENT DOCUMENTS

| | | | |
|---|---|---|---|
| 3,968,498 | 7/1976 | Uchiyama | 346/29 |
| 4,725,849 | 2/1988 | Koike et al. | 346/1.1 |
| 5,156,089 | 10/1992 | McCue et al. | 101/128.4 |
| 5,458,590 | 10/1995 | Schleinz et al. | 604/361 |
| 5,468,553 | 11/1995 | Koike et al. | 428/224 |
| 5,487,614 | 1/1996 | Hale | 400/120.2 |
| 5,488,907 | 2/1996 | Xu et al. | 101/488 |

*Primary Examiner*—Safet Metjahic
*Assistant Examiner*—Christopher Mahoney
*Attorney, Agent, or Firm*—R. Neil Sudol; Henry D. Coleman

[57] ABSTRACT

An apparatus for ink printing a preprogrammed viewable indicia onto a substrate. The apparatus is particularly useful in ink jet printing of designs in single or multi-color inks onto a portion of a substrate such as a garment. The viewable indicia may contain both words and designs or logos and may be programmed into the control system of the apparatus by using either standardized or customized software commands. No setup costs are required other than loading software and ink color selection into the system. The apparatus is capable of creating the indicia through ink jet ink depositing upon flat or rigid substrates as a result of controlled platen movement beneath the ink jet printer head and controlled ink jet printer head movement and ink flow control by a programmed c.p.u.

6 Claims, 4 Drawing Sheets

10
12
20
H
49
27
27
42
47
76
F
50
14
28
26
E
E
74
80
16
32
C
36
22
24
30
50
72
68
70
66
62
64
60
42
49

49
53
56
52
54
58
50
9
46
47
44
42
40
29
28
38
27
48
22
24
26
10
20
12
16
30/32
36
E
F
68
80

APPARATUS FOR INK JET PRINTING

BACKGROUND OF THE INVENTION

1. Scope of Invention

This invention relates generally to imprinting designs on substrate material and particularly to an apparatus for jet ink imprinting of viewable indicia onto a portion of a substrate.

2. Prior Art

Techniques for imprinting designs and other decoration onto substrates, i.e. plastics and garments, include screen printing in which a stencil on a stretched mesh frame is placed over the substrate and sprayed or squeegeed to impart ink or dye onto the substrate. Another currently available technique for this purpose is the utilization of thermo set films and hot stamping, air brushing and pressure sensitive decals. These techniques, although widely in use, nonetheless each present significant drawbacks with respect to convenience, ease of implementation of new designs, expensive equipment and excessive mess and clean-up problem, meeting environmental concerns, and compliance with rules and regulations and human safety and health problems.

The present invention utilizes an ink jet printer loaded with either single or multi-color ink within an apparatus which presents the substrate atop a platen in close proximity to the ink jet nozzle. Heretofore, the benefits of ink jet printing have been untapped as to the feeding of the substrate linearly on a flat platen under the ink jet had been limited to a flexible roll fed substrate such as paper. Movement of the platen forward and aft, in combination with side ways movement of the ink jet printer head, both controlled simultaneously by programmable or pre-programmed software of a central processing unit (c.p.u.) within the apparatus to activate appropriate control mechanisms, presents a significant stride forward. The present invention overcomes many of the drawbacks of the above prior art techniques, where as rigid flat substrates could not be decorated. Also, the substrates associated with the present invention are not only limited to garments or plastics. Additional substrates include any flat material that is of cotton or polyester material, vinyl surfaces, canvas, wood, tile, cement, magnets with vinyl or plastic coatings, and even birthday cakes using a specially formulated FDA approved ink, and paper.

BRIEF SUMMARY OF THE INVENTION

This invention is directed to an apparatus for ink printing preprogrammed viewable indicia onto a substrate. The apparatus prints, through ink jet technology, designs in single or multi-color inks onto any portion of the substrate, i.e. tee shirts, masonite, plexiglass, etc. The viewable decoration may contain both words and designs or logos and may be programmed into the control system of the apparatus by using either standardized or customized software commands. No setup is required other than loading software and ink color selection into the system.

It is therefore an object of this invention to provide an apparatus for ink jet printing of viewable indicia including designs and words onto a flat or rigid substrate.

It is yet another object of this invention to provide an apparatus which utilizes the benefits of ink jet printing systems in conjunction with printing of viewable indicia onto a substrate such as a garment.

It is still another object of this invention to provide an apparatus for imprinting viewable indicia onto a substrate which is easily and quickly reprogrammable on a custom basis or operated with commercially available software to produce a virtually limitless variety of designs.

It is still another object of this invention to provide an apparatus for ink jet printing of custom designs onto substrate material without the need for expensive and time-consuming set-up procedures notwithstanding size limitation.

It is still further an object of this invention to provide an apparatus for imprinting viewable indicia onto a substrate which complies with environmental concerns and current rules and regulations, and human safety and health concerns.

In accordance with these and other objects which will become apparent hereinafter, the instant invention will now be described with reference to the accompanying drawings.

DETAILED DESCRIPTION OF THE INVENTION

Figure 1:
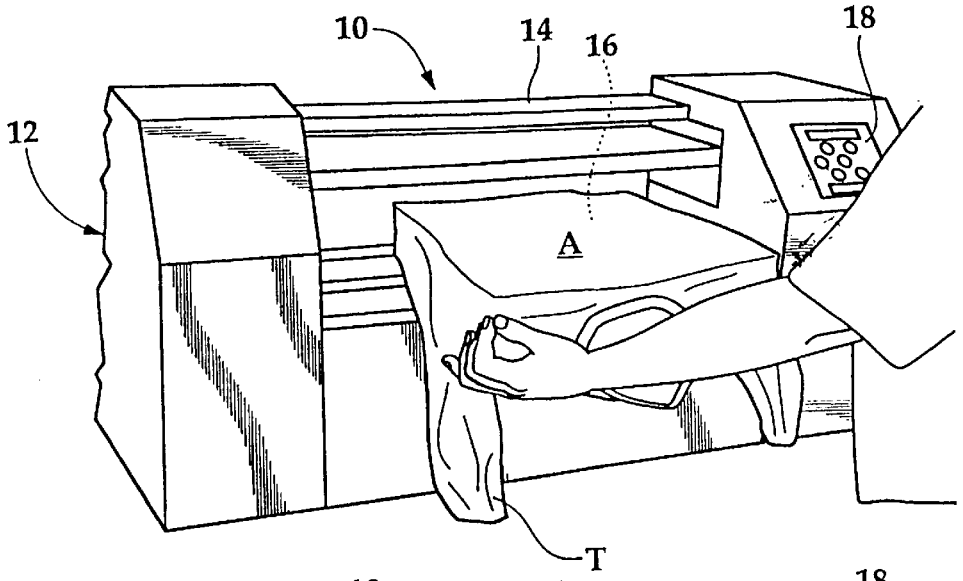
FIG. 1 is a perspective view of the invention being loaded for imprinting a tee shirt.

Referring now to the drawings, the invention is shown generally at numeral 10 and includes a frame or housing 12 which is fabricated of sheet metal panels folded and connected into the overall configuration shown. Operably mounted within the housing 12 is an ink jet printer system shown in phantom generally at numeral 20 as best seen in its overall configuration in FIGS. 4, 5 and 6. The preferred model of ink jet printer is distributed by Cal Comp, Model #5324, manufactured by Canon and installed with a Canon printer head which is also shown in phantom generally at 22.

Figure 4:
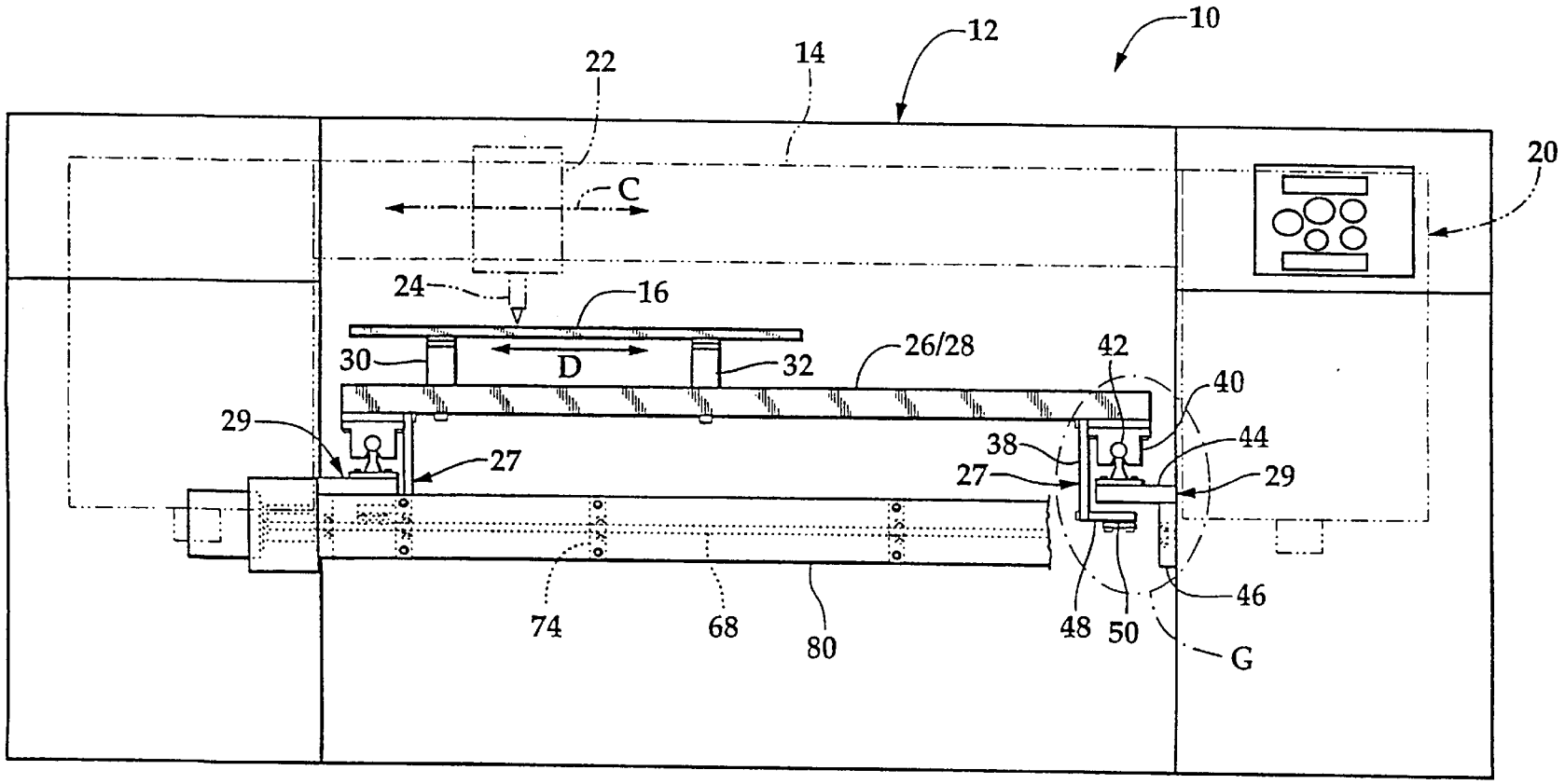
FIG. 4 is a front elevation schematic view, partially broken, depicting the invention shown in FIG. 1.
Figure 5:
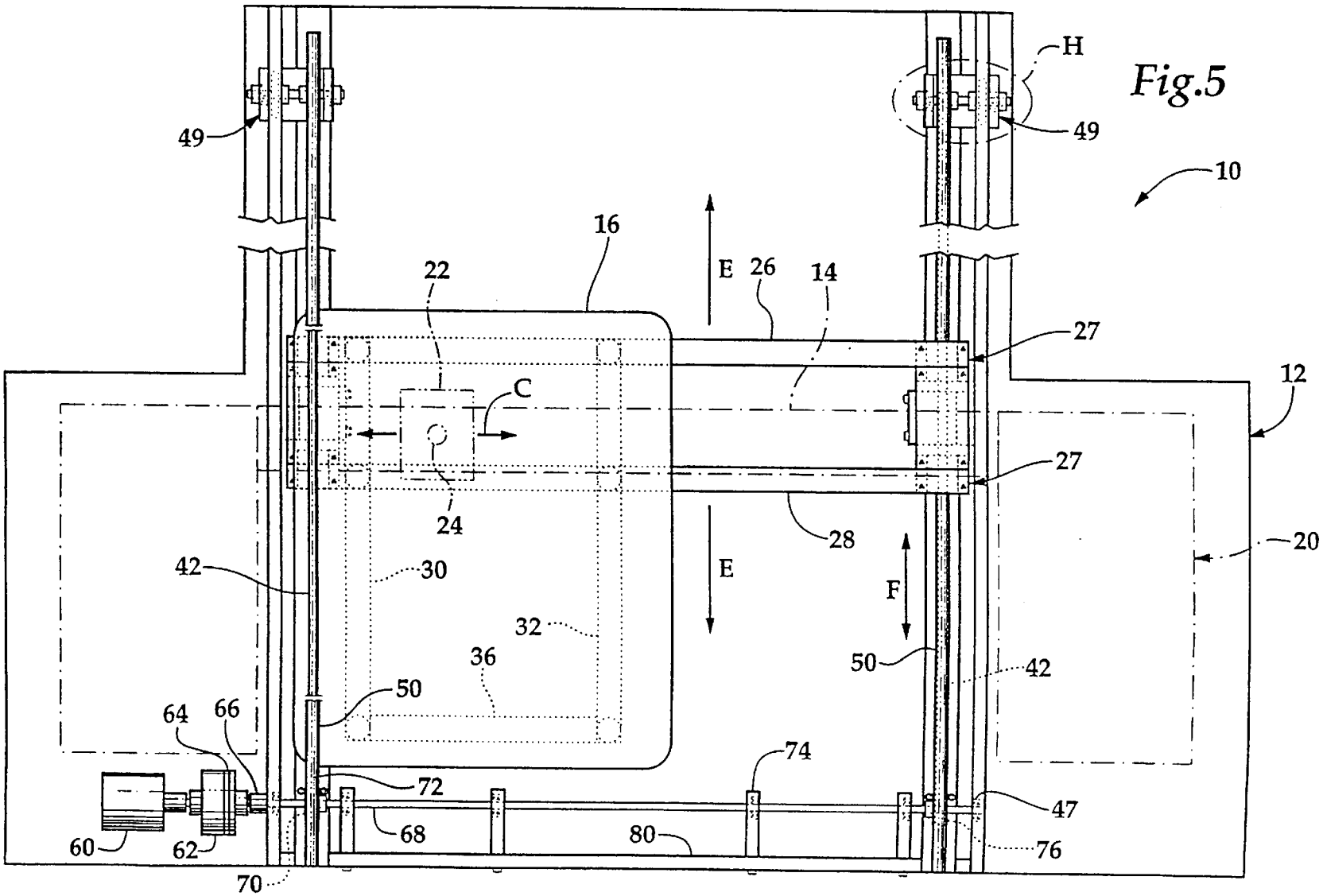
FIG. 5 is a top plan schematic partially broken view of FIG. 4.

Without going into detail with regard to the specific components of this commercially available ink jet printer, the printer 20 includes a translation or carriage bar 14 which slidably supports and controls an ink jet printer head 22 and its ink dispensing nozzle 24 for slidable translation side to side with respect to the width of the apparatus 10 in the direction of arrows C in FIGS. 4 and 5.

Figures 6, 7, 8, 9:
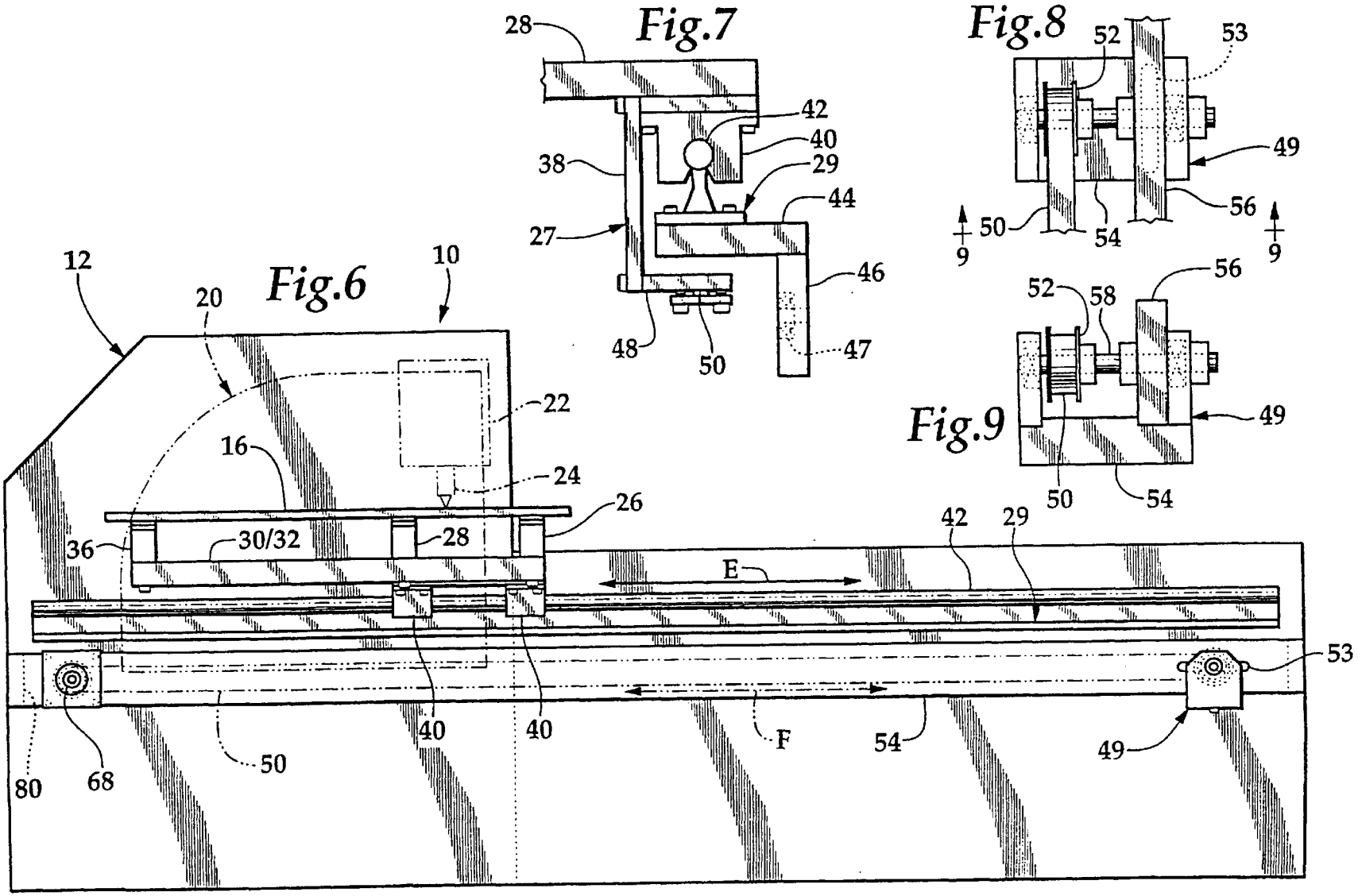
FIG. 6 is a side elevation schematic view of FIG. 4.
FIG. 7 is an enlarged view of area G in FIG. 4.
FIG. 8 is an enlarged view of area H in FIG. 5.
FIG. 9 is a view in the direction of arrows 9—9 in FIG. 8.

The apparatus 10 also includes a flat platen 16 which is positionable in close proximity with the ink jet nozzle 24 as best seen in FIGS. 4 and 6. The platen 16 is supported by a carriage assembly 26/28 and carriage extension 30/32 connected to cross bar 36. The carriage assembly 26/28 is supported at each end thereof for slidable forward and rearward translation with respect to the length of the apparatus 10 atop cylindrical, straight rails 42 by rail bearings 40. As best seen in FIG. 7, the rails 42 disposed along the length of either side of the inner upright panel of the main portion of the housing 12 are supported by the L-shaped arrangement of a connected rail plate member 44 and a side plate member 46. By this arrangement, the platen 16 is fully translatable fore and aft in the direction of arrow E on rails 42 and with respect to housing 12 and ink jet nozzle 24.

Movement in the direction of arrow C of the ink jet head 22 is accomplished by the internal carriage 14 components of the available production ink jet printer system 20 as previously described. Controlled movement in the direction of arrow E of the platen 16 is accomplished by interengagement of two spaced apart movable endless drive belts 50 by a suitable clamping arrangement shown in FIG. 7 with each belt plate 48 and upright tie plate 38. Each of the assemblies 27 is connected to the carriage member 26/28 as shown in FIG. 7 immediately adjacent to the side rail assembly 29.

The endless drive belt 50 is supported at a rearward end thereof by the take-up assemblies 49 positioned on either side of the frame 12 as best seen in FIGS. 8 and 9. Each take-up assembly 49 includes a timing pulley 52 mounted on shaft 58 which is bearing mounted at each end thereof as shown. The forwardly end of the endless drive belt 50 is drivingly supported on pulleys 70 and 76. Each pulley 70 and 76 is driven by rotatably mounted drive shaft 68. The drive shaft 68 is supported mid way by bearings within struts 74. The drive shaft 68 is rotatably driven by an electromagnetic clutch motor 60 shown in FIG. 5 which is operably connected to one end of the drive shaft 68 by step plate 62 and step support 64 acting through coupler 66. By this arrangement, appropriate controlled rotation of drive shaft 68 acting through pulleys 70 and 76 upon endless drive belt 50 in the direction of arrow F affect movement in the direction of arrow E of the platen 16.

The overall coordinated controlled movement of the platen 16 in the direction of arrow E and the ink jet head 22 in the direction of arrow C is accomplished through a software arrangement which operably drives a conventional c.p.u. within the ink jet printer 20. The software controlled arrangement may be pre-programmed as commercially available drafting and design software or may be custom tailored as desired. Movement and ink dispensing control are effected by the software controlled c.p.u. as provided with the printer. Movement of the platen 16 is effected by connecting the c.p.u. signal output which normally controls paper feed to the motor 60.

Figure 2:
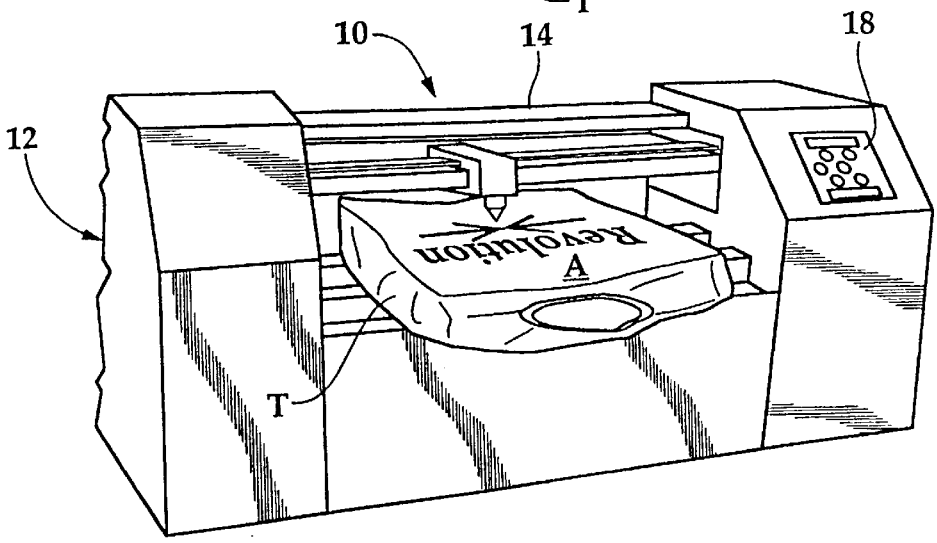
FIG. 2 is a view similar to FIG. 1 with the apparatus in use.
Figure 3:
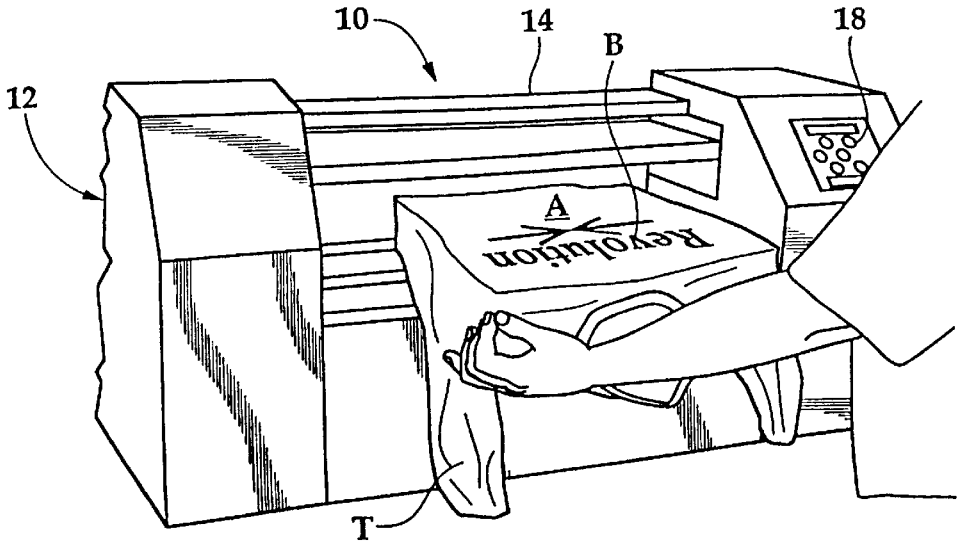
FIG. 3 is a view similar to FIG. 1 depicting the unloading of the tee shirt with design and word indicia printing completed.

In use, particularly referring to FIGS. 1 to 3, a substrate such as a tee shirt T is loaded atop platen 16 so as to present a working surface A for imprinting of viewable indicia thereon. The platen 16 is then indexed rearwardly so as to place the working surface A beneath the ink jet printer head 22. The system is then regulated by control panel 18 which, acting through the software contained within the ink jet printer assembly 20 to imprint the appropriate viewable indicia B as seen in FIG. 3 thereon. After imprinting of the viewable indicia B onto the tee shirt T the platen 16 is then withdrawn and the tee shirt garment T is removed for drying.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A printing method comprising:

providing a printing apparatus including a platen movably mounted on a frame and further including an inkjet printing head movably mounted to said frame;

providing a flexible printing substrate larger in at least one dimension than said platen;

positioning said flexible printing substrate atop said platen so that a preselected panel of said substrate is placed in a printing plane while additional portions of said substrate are draped downwardly over edges of said platen;

tucking said additional portions under said platen;

after the positioning of said flexible printing substrate atop said platen, moving said platen and said printing head; and during the moving of said platen and said printing head, discharging ink via said printing head onto said substrate in a predetermined pattern.

2. The method defined in claim 1 wherein said substrate is maintained in a fixed position atop said platen during the moving of said platen and said printing head.

3. The method defined in claim 2, further comprising wrapping said additional portion around said platen so that vertical surfaces of said platen are covered by said additional portions.

4. The method defined in claim 1, further comprising wrapping said additional portions around said platen so that vertical surfaces of said platen are covered by said additional portions.

5. A printing apparatus comprising:

a frame;

a platen movably mounted to said frame for motion in a first direction;

an inkjet printing head movably mounted to said frame for motion in a second direction at an angle to said first direction; and a carriage assembly mounting said platen to said frame, said carriage assembly including a pair of elongate members oriented parallel to one another, spaced from a lower surface of said platen and extending proximate to respective opposing edges of said platen, said elongate members being stationary relative to said platen.

6. The apparatus defined in claim 5 wherein said elongate members are first elongate members, said carriage assembly further including a pair of second elongate members connected to said second elongate members and extending perpendicularly thereto, said second elongate members being movably mounted at opposite ends to a pair of rails.

* * * * *

US006095628C1

(12) EX PARTE REEXAMINATION CERTIFICATE (8121st)

United States Patent

Rhome

(10) Number: US 6,095,628 C1

(45) Certificate Issued: Mar. 29, 2011

(54) APPARATUS FOR INK JET PRINTING

(75) Inventor: Matthew Rhome, Bradenton, FL (US)

(73) Assignee: Direct Imaging Systems, Inc., Bradenton, FL (US)

Reexamination Request:
No. 90/008,211, Sep. 8, 2006

Reexamination Certificate for:

| | |
|---|---|
| Patent No.: | **6,095,628** |
| Issued: | **Aug. 1, 2000** |
| Appl. No.: | **08/683,845** |
| Filed: | **Jul. 19, 1996** |

(51) Int. Cl.

| | |
|---|---|
| ***B41J 3/00*** | (2006.01) |
| ***B41J 2/01*** | (2006.01) |

(52) U.S. Cl. ..... 347/4; 347/105

(58) Field of Classification Search ..... None
See application file for complete search history.

(56) References Cited

U.S. PATENT DOCUMENTS

| | | | |
|---|---|---|---|
| 3,977,322 | A | 8/1976 | Jaffa |
| 4,098,222 | A | 7/1978 | Geary et al. |
| 4,474,109 | A | 10/1984 | Yara |
| 4,550,679 | A | 11/1985 | Pipa et al. |

FOREIGN PATENT DOCUMENTS

| | | |
|---|---|---|
| JP | H6122569 | 12/1995 |

OTHER PUBLICATIONS

Fresener, Scott & Pat, Encyclopedia of Garment Printing, 1989, Fresener Corp., Scottsdale, Arizona. Pgs include front cover, copyright page, pp. 444, 492, 506, 508, 536, 780.

*Primary Examiner*—Minh T Nguyen

(57) ABSTRACT

An apparatus for ink printing a preprogrammed viewable indicia onto a substrate. The apparatus is particularly useful in ink jet printing of designs in single or multi-color inks onto a portion of a substrate such as a garment. The viewable indicia may contain both words and designs or logos and may be programmed into the control system of the apparatus by using either standardized or customized software commands. No setup costs are required other than loading software and ink color selection into the system. The apparatus is capable of creating the indicia through ink jet ink depositing upon flat or rigid substrates as a result of controlled platen movement beneath the ink jet printer head and controlled ink jet printer head movement and ink flow control by a programmed c.p.u.

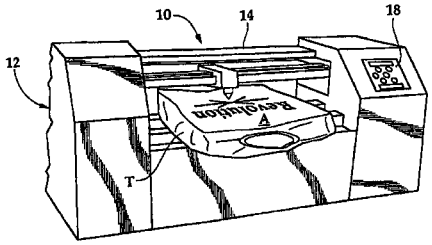

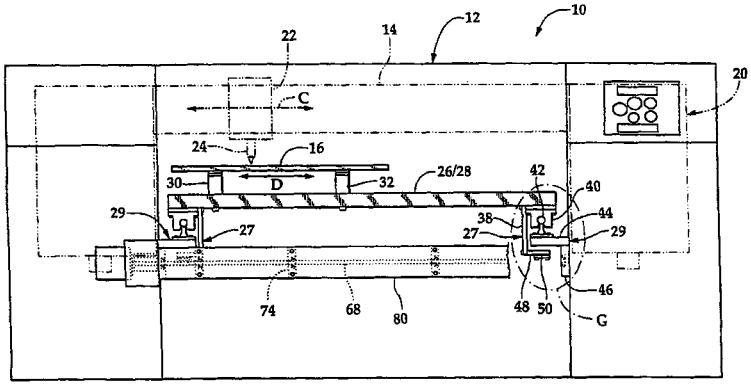

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-4 and 6 are cancelled.

Claim 5 is determined to be patentable as amended.

5. A printing apparatus comprising:

a frame;

a platen movably mounted to said frame for motion in a first direction;

an inkjet printing head movably mounted to said frame for motion in a second direction at an angle to said first direction; and a carriage assembly mounting said platen to said frame, said carriage assembly including a pair of elongate members oriented parallel to one another, spaced from a lower surface of said platen and extending proximate to respective opposing edges of said platen, said elongate members being stationary relative to said platen *wherein said elongate members are first elongate members, said carriage assembly further including a pair of second elongate members connected to said first elongate members and extending perpendicularly thereto, said second elongate members being movably mounted at opposite ends to a pair of rails*.

* * * * *